United States Patent [19]

Lundström

[11] Patent Number: 4,500,588

[45] Date of Patent: Feb. 19, 1985

[54] CONVEYOR FELT FOR PAPER MAKING AND A METHOD OF MANUFACTURING SUCH A FELT

[75] Inventor: Kristian Lundström, Pirkkala, Finland

[73] Assignee: Tamfelt Oy AB, Tampere, Finland

[21] Appl. No.: 446,623

[22] Filed: Dec. 3, 1982

[30] Foreign Application Priority Data

Oct. 8, 1982 [FI] Finland ..... 823431

[51] Int. Cl.[3] ..... B32B 7/02

[52] U.S. Cl. ..... 428/212; 139/383 A; 156/148; 156/155; 156/308.2; 162/DIG. 1; 428/234; 428/235; 428/239; 428/280; 428/282; 428/284; 428/296; 428/298; 428/300

[58] Field of Search ..... 162/DIG. 1; 139/383 A; 428/234, 235, 238, 239, 297, 298, 299, 300, 301, 296, 280, 281, 282, 283, 284, 212; 156/148, 155, 308.2

[56] References Cited

U.S. PATENT DOCUMENTS 4,151,323 4/1979 Christie ..... 428/300
4,199,401 4/1980 Lui et al. ..... 162/358
4,224,372 9/1980 Romanski ..... 428/257

*Primary Examiner*—James J. Bell
*Attorney, Agent, or Firm*—Lowe King Price & Becker

[57] ABSTRACT

A conveyor felt for conveying a paper web through a press section of a paper machine, comprising a support fabric (1) formed by a yarn structure and fibre bat layer (2) needled to the support fabric at least on one side thereof. The felt is, with the exception of the surface portion (4) of the fibre bat layer facing the web, filled with a filling material (3) so that the felt is completely air impermeable and has a chamois-like surface (2*a*). A barrier layer is formed in the fibre bat layer for preventing the filling material from penetrating into the surface facing the web. The barrier layer is obtained by calendering the surface of the fibre bat layer facing the web so as to make it smooth and compact or by providing in the fibre bat layer a fine-fibered fibre bat layer or a filtering intermediate layer on the side of the surface facing the web. The filling of the felt prevents blowing and rewetting at a conveying speed of up to 1000 m/min although the conveyor felt has a chamois-like surface facing the web.

14 Claims, 3 Drawing Figures

CONVEYOR FELT FOR PAPER MAKING AND A METHOD OF MANUFACTURING SUCH A FELT

Figure 1:
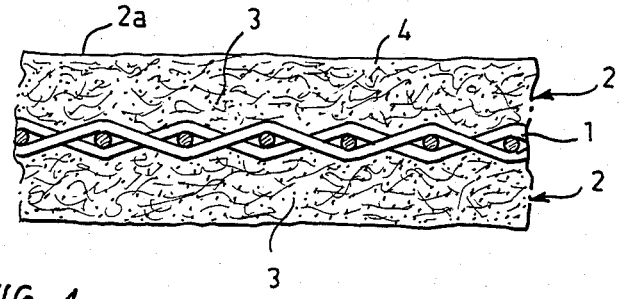

The present invention relates to a conveyor felt for conveying a fibre web through a press section of a paper machine, said conveyor felt comprising at least one needled fibre bat layer.

Such a felt is used for conveying a fibre web through the press section of a paper machine in which the web is in contact with the conveyor felt for a relatively long time.

The use of a conventional felt as a conveyor felt causes considerable blowing and rewetting problems because of the air and water carried by the felt.

A conventional felt carries air in pores in the surface and inside the felt. As the felt is compressed in the nip, air is forced out of the felt and lifts the web off the felt while causing so-called blowing which stretches, wrinkles or breaks the web. The higher the speed of the paper machine, the more air is carried by the felt into the press nip and the more complicated is the blowing problem. This often sets a limit to the speed or the compressive pressure of the paper machine.

From Finnish patent application No. 773,981 it is previously known to reduce the amount of air carried by a felt by subjecting the felt simultaneously to a heating, compressing and tensioning action in order to smooth the surface of the felt. However, in practice, it has been noted that such a smoothing of the felt surface is applied only to a surface layer which is rapidly worn off in the heavy wearing conditions which the fibres in the surface are subjected to as the felt passes through a hard nip.

Neither does the coating of a conventional felt with plastic, rubber or any other kind of coating material solve the felt blowing problem. The various coating methods suffer from the disadvantage that the surface will be too smooth and compact. This hampers the loosening of the web from the felt because a very smooth and compact surface has a strong adhesion. For example, a rubber belt is for this reason quite unsuitable as a conveyor felt expressly because of the bad surface properties.

It is previously known, for example, from Finnish patent application No. 2848/74, to use in the surface of a felt relatively fine fibres and in the inner layers relatively coarse fibres. It is true that the surface of the felt in such a felt structure has smaller pores, which are advantageous because of the small amount of air carried by the pores, but the amount of air contained in the pores of the coarse fibre layers under the surface easily causes blowing problems as the felt is compressed in the nip and air is discharged from the felt.

Rewetting is a problem nearly as significant as blowing. Because the felt and web are adhered to each other for a relatively long period of time, the water in the felt may be transferred into the web if the surface capillaries in the felt are too large. The surface of a conventional press felt has such large pores and capillaries from which water is easily absorbed into the web having very small capillaries.

In addition, the surface of a conventional press felt is to such an extent uneven that the web does not adhere thereto very firmly. This again may result in the fact that the web, instead of travelling along with the conveyor felt, travels along with another felt mainly intended for dewatering.

In order to avoid the blowing and rewetting problem it has previously been suggested to entirely omit the felt from the press section of a paper machine. When no felt is used, the web will get into direct contact with the surface of the press roll. In such a case, the loosening of the web directly from the surface of the roll may cause problems due to the strong adhesion between the web and the smooth roll surface which damages the web at high speeds of the paper machine.

It is an object of the present invention to provide a conveyor felt which permits the conveyance of the web to be dried for a longer time and at a high speed in contact with the felt through the press section of a paper machine without the conveyor felt causing the above mentioned blowing, rewetting and adhesion problems. This object is achieved by means of a conveyor felt according to the invention which is characterized in that the felt is, except for the surface portion of the fibre bat layer facing the web, filled with a filling material so as to be completely air impermeable.

The invention is based on the idea of filling the pores within the felt and in the surface of the felt with a filling material while maintaining a felt-like but compact surface layer for the conveyor felt. In this case, the compressibility of conveyor felt is made as small as possible by selecting the filling material so that it eliminates the elastic movement of the felt. The conveyor felt according to the invention permits an increase of the speed of the paper machine press section to more than 1000 m/min without the felt causing any blowing or rewetting problems because the felt absorbs only very small amounts of water and air. Thus, the felt does not participate in the dewatering of the web which is carried out by conventional open press felts. Due to the surface properties of the felt, the adhesion of the surface to the fibre web is small so that it can be easily loosened from the felt and there is no risk of rupture of the paper.

It is preferable to use for the felt very fine fibres throughout the felt, said fibres having a fineness of 6 den or finer. Thus, the pores in the felt will be relatively fine so that the felt can be filled with a reasonable amount of filling material.

It has been noted in experiments that the thickness of the felt under a compression of 14 Mpa preferably should be at least 45% of the original thickness. In this way, it is possible to reduce the elastic movement of the felt which otherwise is considerable because a conventional felt is compressed to as much as one third of its original thickness.

The invention also relates to a method of manufacturing a conveyor felt according to the invention characterized in that the filling of the felt with filling material is carried out so that no separate coating layer of filling material is formed on the surface of the felt facing the web. In this way, a chamois-like surface which does not adhere too firmly to the fibre web is obtained in the felt inspite of its complete filling.

A barrier layer can be formed in the felt by calendering the surface of the felt facing the web before the filling treatment. In this way, a smooth and compact surface is obtained in the felt so that the calendered surface layer prevents the filling material from penetrating up to the surface of the felt facing the web and the felt-like properties of the surface are maintained.

The barrier layer can also be produced by using in the surface of the felt facing the web finer fibres than in the underlying layers whereby the filling material, which is supplied to the felt from the side opposite the web side of the felt, stops at this fine fibre layer. It is preferable to also include a calendering step in this manufacturing method whereby no open pores remain in the surface of the barrier layer but the pores are closed by the heat and compression during calendering. The finer fibres are preferably 4 den or finer while the coarser fibres are preferably 6 den or finer.

The barrier layer can also be obtained by providing under the surface of the felt facing the web a filtering intermediate layer, in which case it is preferable that the intermediate layer is located between a fine fibre layer on the surface and an underlying coarse fibre layer. The filtering intermediate layer may, for example, comprise a non-woven fibric having a weight of 20 to 200 g/m$^2$. The intermediate layer prevents the filling material from penetrating into the surface of the conveyor felt.

The filling treatment can also be carried out by spraying or impregnating the felt in a foulard or by applying the filling material to the felt by means of a lifting roll. The felt is then dried and the filling material is fixed or vulcanized.

In principle, the invention can be applied also by subjecting a base fabric for the felt or a base fabric and a fibre bat layer to a filling treatment and thereafter needling or laminating a surface fibre bat layer to the filled base fabric or to the filled fibre bat layer, respectively. Finally, the felt is calendered for smoothing and compacting the surface.

Figure 2:
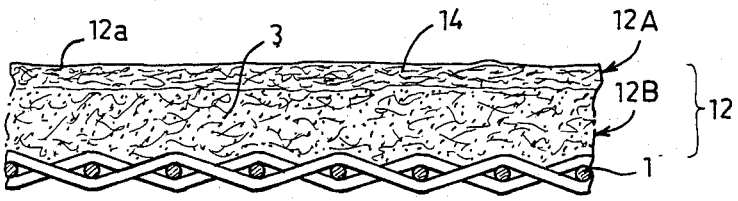
Figure 3:
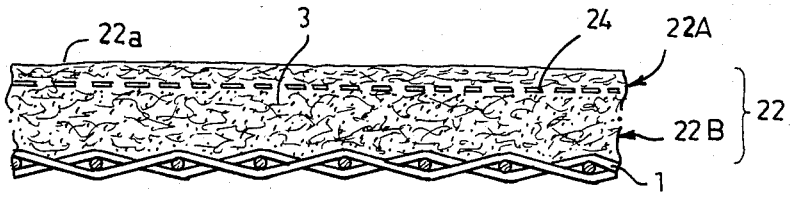

In the following, the invention will be described in more detail with reference to the accompanying drawing, in which:

FIG. 1 is a schematic cross-section of a first embodiment of a conveyor felt according to the invention, FIG. 2 illustrates a second embodiment of the conveyor felt, and FIG. 3 illustrates a third embodiment of the conveyor felt.

The conveyor felt illustrated in FIG. 1 comprises a support fabric 1 and fibre bat layers 2 needled on both sides of the support fabric as well as a filling material 3 filling the support fabric and the fibre bat layers with the exception of the surface facing the web.

The support fabric 1 provides the felt with high strength values both in the longitudinal and transverse direction. The support fabric is similar to those used as base fabrics in conventional needled paper machine felts. The support fabric can be woven of monofilament, multifilament or spun yarns. The yarn structure can be single- or multilayered.

The fibre bat layers 2 consist of fibres having a fineness of at least 6 den. The fibres may comprise fibres known from the manufacture of conventional press felts. The layers 2 are produced by positioning superimposed card layers on the support fabric and by fastening the card layers by needling to each other and to the support fabric.

A resin emulsion 3 is used as the filling material filler 3. A suitable resin is e.g. acrylic resin or any other of the following resins: epoxy, phenol, polyvinyl acetate, styrene and butadiene resin or any other similar resin. A hard resin results in a felt with very little compressibility, while a softer resin somewhat increases the compressibility. A synthetic or natural rubber latex, polyurethane or a silicone elastomer may also be used as filling material.

The surface 2*a* of the felt facing the web is calendered to a smooth and compact barrier layer 4 in which the pores have been blocked due to the action of heat and compression during calendering so that the barrier layer prevents the filling material from penetrating into the surface of the felt facing the web. The filling material fills the remainder of the felt so that it is completely impermeable to air.

The conveyor felt illustrated in FIG. 2 differs from the preceding one in that fibre bat layer 12 comprises a fine-fibered layer 12A facing the web and an underlying coarse-fibered layer 12B. The fine-fibered layer 12A forms a barrier layer 14 which prevents the filling material from penetrating into surface 12*a* of the felt. The surface 12*a* is preferably calendered. The remainder of the felt is entirely filled with filling material.

The conveyor felt illustrated in FIG. 3 differs from the one shown in FIG. 2 in that between the fine-fibered layer 22A and the coarse-fibered layer 22B of the fibre bat layer 22 is inserted a non-woven fabric 24 forming a filtering intermediate layer preventing the filling material from penetrating into surface layer 22A and surface 22*a* of the felt. The remaining felt is completely filled with filling material.

EXAMPLE 1

A 6 den fibre bat layer was needled on both sides of a base fabric woven of monofilament yarns in one layer. The weight of the felt so obtained was 1400 g/m$^2$.

Hereinafter, the felt was calendered for smoothing and compacting the surface thereof facing the web. The calendered felt was filled with acrylic resin in a foulard, and the excessive resin was pressed out of the felt. Finally the felt was dried and the resin was fixed. No filling material appeared on the calendered surface facing the web.

The felt operated faultlessly as a conveyor felt in a paper machine press at a speed of more than 1000 m/min.

EXAMPLE 2

A 6 den fibre bat layer was needled on the web side of a base fabric woven in two layers and a 3.74 den fibre layer was applied on the surface of said fibre bat layer. The weight of the felt was 1250 g/m$^2$.

On the surface of the felt opposite the web side was by means of a roll applied an acrylic resin emulsion which penetrated into the support layer of the felt and into the fibre bat layer up to the fine-fibered surface layer. Finally the felt was dried and the resin was fixed.

The felt operated faultlessly as a conveyor felt in a paper machine press at a speed of more than 1000 m/min.

The drawing and the related description are only intended to illustrate the idea of the invention. In its details, the felt according to the invention and the method of manufacturing said felt may vary within the scope of the claims. Thus, it is possible to manufacture the felt without any support fabric, in which case the fibre bat layer is made of superimposed non-woven fibre layers which are needled to each other to form a layer which withstands the strains of the filler treatment without any support fabric. Alternatively, the support fabric can be made of yarns which can be dissolved, for example, with hot water before the filler treatment. Suitable yarn raw materials are alginate and polyvinyl alcohol. In this way, a conveyor felt is obtained which, in use leaves no markings in the paper web. However, a support fabric permits the making of the fibre bat as a continuous process from card layers.

What I claim is:

1. A conveyor felt for supporting and conveying a fibre web through a press section of a paper machine, said conveyor felt comprising at least one needled fibre bat layer, wherein said fibre bat layer, except for a surface portion thereof facing the web, includes a resinous or elastomeric air impermeable filling material filling pores of the bat between individual fibres thereof so that the bat layer is substantially entirely air impermeable, said filling material tending to prevent rewetting of the felt and eliminate compressibility of the conveyor felt to prevent the occurrence of blowing as the felt is compressed in a press nip so that the fibre web does not lift off the felt.

2. A conveyor felt according to claim 1, wherein said fibre bat layer is needled on one side of a support fabric of a yarn structure, said support fabric being filled from one surface to the other surface thereof with said filling material so as to be completely air impermeable.

3. A conveyor felt according to claim 1 wherein said web facing surface of the fibre layer is calendered to form a smooth and compact barrier layer preventing the filling material from penetrating into said surface.

4. A conveyor felt according to claim 1, wherein said fibre bat layer includes a fine-fibered layer facing the web and a coarse-fibered layer facing the support fabric, said fine-fibered layer preventing said filling material from penetrating into the web facing surface of the fibre bat layer.

5. A conveyor felt according to claim 4, further including a filtering intermediate layer located between said fine-fibre layer and the coarse fibre layer to prevent the filling material from penetrating into said web facing surface.

6. A conveyor felt according to claim 4, wherein the fibres of said fine-fibered layer are 4 den or finer and the fibres of said coarse-fibered layer are 6 den or finer.

7. The felt according to claim 1, wherein said surface portion of the fibre bat layer facing the web is a chamois-like surface.

8. The conveyor felt of claim 1, wherein said fibre bat layer is formed from a series of superimposed non-woven fibre layers needled together without any support fabric.

9. A method of manufacturing a conveyor felt used for conveying a paper web through a press section of a paper machine, comprising the steps of needling a coarse fibre bat layer to a support fabric;

applying a fine fibre bat layer to the coarse fiber layer;

applying to the coarse fibre bat layer and support fabric from a side of the felt opposite a web facing surface of the fine fibre bat layer a resinous or elastomeric air impermeable filling material that penetrates the support fabric and coarse fibre bat layer so that said filling material fills pores of the coarse layer between individual fibres thereof so that said coarse layer is substantially entirely air impermeable except for said fine fibre bat layer; and drying the felt to fix the filling material.

10. A method according to claim 9, comprising the further step of calendering the web facing surface of the fine fibre bat layer to form a barrier layer preventing the filling material from penetrating into the web facing surface.

11. A method according to claim 9, comprising the further step of inserting a non-woven fabric between the fine fibre bat layer and coarse layer, said non-woven fabric preventing filling material from penetrating into the surface of the fine fibre bat layer facing the web.

12. A method of manufacturing a conveyor felt used for conveying a paper web through a press section of a paper machine, comprising the steps of needling a fibre bat layer at least to one side of a support fabric of yarn structure; calendaring the surface of the fibre bat layer facing the web so that the web facing surface is smooth and compact and applying to the fibre bat layer and support fabric from a side of the felt opposite the web facing surface a quantity of resinous or elastomeric air impermeable filling material that is sufficient to penetrate the support fabric and fibre bat layer except for the web facing surface so that said filling material fills pores of the bat between individual fibers thereof so that the bat layer is substantially completely air impermeable except for said web facing surface portion; and drying the felt to fix that filling material.

13. A method according to claim 9, comprising the further step of dissolving the support fabric before filling the fibre bat layer with the filling material.

14. A method of manufacturing a conveyor felt used for conveying a paper web through a press section of a paper machine, comprising the steps of:

(a) needling together a series of superimposed non-woven fibre layers to form a fibre bat layer;

(b) calendaring the surface of the fibre bat layer facing the web so that the web facing surface is smooth and compact;

(c) applying to the fibre bat layer from a side of the felt opposite a web facing surface a resinous or elastomeric air impermeable filling material that penetrates the fibre bat layer except for the web facing surface thereof so that said filling material fills pores of the bat between individual fibres thereof so that the bat layer is substantially entirely air impremeable except for said web facing surface; and (d) drying the felt to fix the filling material.

* * * * *